US006871410B1

(12) United States Patent
Le Jeune

(10) Patent No.: US 6,871,410 B1
(45) Date of Patent: Mar. 29, 2005

(54) AUTONOMOUS APPARATUS AND METHOD FOR ACQUIRING BOREHOLE DEVIATION DATA

(76) Inventor: Robert J. Le Jeune, 108 St. Benjamin Dr., Lafayette, LA (US) 70506

( * ) Notice: Subject to any disclaimer, the term of this patent is extended or adjusted under 35 U.S.C. 154(b) by 0 days.

(21) Appl. No.: 10/785,527

(22) Filed: Feb. 24, 2004

(51) Int. Cl.[7] ..... E21B 47/022

(52) U.S. Cl. ..... 33/313; 33/304; 702/6; 175/40

(58) Field of Search ..... 33/313, 304, 312, 33/315, 544, 544.2; 702/6; 175/40, 57, 44, 45

(56) References Cited

U.S. PATENT DOCUMENTS

| | | | | | |
|---|---|---|---|---|---|
| 3,587,175 | A | | 6/1971 | Armistead | |
| 4,171,578 | A | | 10/1979 | Meador | |
| 4,231,252 | A | | 11/1980 | Cherkson | |
| 4,393,598 | A | | 7/1983 | Powell et al. | |
| 4,454,756 | A | * | 6/1984 | Sharp et al. | 33/313 |
| 4,485,563 | A | | 12/1984 | Sharp et al. | |
| 4,527,122 | A | | 7/1985 | Pyatt et al. | |
| 4,734,860 | A | | 3/1988 | Egli et al. | |
| 5,331,578 | A | * | 7/1994 | Stieler | 33/313 |
| 5,806,195 | A | | 9/1998 | Uttecht et al. | |
| 5,812,068 | A | | 9/1998 | Wisler et al. | |
| 6,227,310 | B1 | | 5/2001 | Jamieson | |
| 6,321,456 | B1 | | 11/2001 | McElhinnney | |
| 6,453,239 | B1 | * | 9/2002 | Shirasaka et al. | 33/304 |
| 6,467,557 | B1 | * | 10/2002 | Krueger et al. | 175/45 |
| 6,480,119 | B1 | | 11/2002 | McElhinney | |
| 6,499,545 | B1 | * | 12/2002 | MacGugan | 175/45 |
| 6,738,720 | B2 | * | 5/2004 | Odom et al. | 720/6 |

OTHER PUBLICATIONS

AusMine Manufacturers & Distributors, Catalog on Internet, item Ausmine Survey Running Gear.

Advanced Orientation Systems, Inc. USA www.aositilt.com, EZ Compass 3/Magnetometer rev 2, Catalog.

Ranger Survey Systems Running Gear,Catalog on Internet.

* cited by examiner

*Primary Examiner*—Christopher W. Fulton
(74) *Attorney, Agent, or Firm*—Robert N. Montgomery

(57) ABSTRACT

An autonomous down hole survey tool and method for determining deviation angles of a well bore while tripping. The instrument package assembly is carried in a commercially available running gear and utilizes a low voltage solid state electronic apparatus in cooperation with a method for detecting and correlating desired measurements such as pitch, roll, azimuth and temperature taken from a bored hole in an autonomous manner and electronically recovering such data from the instrument upon its return to the surface. The apparatus includes electronic measurement sensing circuitry that includes a compass/magnetometer utilizing a tilt compensated linear/compass, dual axis tilt system, housed in a high tensile strength non-metallic casing sleeve with a self centering capability. The system further includes electronic communications programming and retrieval cabling and a portable computer processor unit. The method of operation includes the steps of providing the autonomous instrument with an onboard computer/program set for acquiring a plurality of desired duplicate measurements taken from the borehole at pretimed intervals, storing a plurality of such measurements taken along the borehole path with their associated time marks stored in memory, and providing a method for manually inserting depths into a surface computer coordinated with the down hole timed intervals.

31 Claims, 8 Drawing Sheets

AUTONOMOUS APPARATUS AND METHOD FOR ACQUIRING BOREHOLE DEVIATION DATA

1. FIELD OF THE INVENTION

This invention relates generally to apparatus and methodology used to determine the deviations from the prescribed path of a borehole and more particularly to a low voltage autonomous instrument package used to acquire deviation angle data down hole and a method for retrieving and correlating the data upon the instrument's return to the surface.

2. GENERAL BACKGROUND

During the process of drilling an oil or gas exploratory or development well borehole, it is necessary to determine where the drill bit is located at all times and the bit's deviation from the prescribed path. Depending on the type of well, such as vertical or directional bore, it is imperative that down hole measurements such as direction and deviation angle relative to a vertical axis be measured accurately and frequently.

Mechanical autonomous devices presently used to measure deviation angle "only", include pendulum pin prick mechanisms coupled to a mechanical timer housed in a relatively slender tube commonly referred to as one shot deviation recorders. The mechanical timer is set at the surface of the well bore prior to dropping the tube down the central bore of the drill string. The mechanical timer is manually set to a predetermined time for activation of the pendulum pin prick mechanism at approximately the same time the slender tube containing the timer and the pendulum pin prick mechanism reaches the bottom of the borehole. The pendulum pin prick mechanism, when activated by the mechanical timer, causes a pin prick hole to be formed in a paper target at an angle congruent with the angle the pendulum pin prick mechanism is deviated from vertical. The paper target has concentric rings representing degrees of deviation, printed on the surface exposed to the pendulum pinprick mechanism. The slender tube containing a pendulum pinprick mechanism and a mechanical timer is either retrieved by wire line or "tripped" out of the borehole with the drill pipe. The paper target is then retrieved from the pendulum housing and inspected. The deviation angle in degrees is then estimated by determining the location of the pinprick hole formed by the pendulum pinprick mechanism and the nearest printed concentric circle on the paper target.

The pendulum pin prick mechanism and a mechanical timer method of retrieving borehole measurements is an industry standard that is the most commonly used method of inexpensive and "quick check" of borehole measurements. However, the use of this method requires that all drilling activities cease and creates a downtime situation that leaves the drilling operators exposed to problems such as "stuck pipe", lost circulation, or "blowout', occurring in open hole conditions. The potential always exists of a premature timer activation or non-activation, and, since this is a "one shot only" method, such failure would require the method be repeated resulting in additional downtime costs. Other problems exist with the pendulum pinprick mechanism and its mechanical timer method including limited angle range of the instrument and the fact that the resulting paper target is simply an estimate and thus open to interpretation.

Other methods employed by the oil and gas industry to measure borehole parameters is the gyroscopic deviation angle or "Gyro Multi-shot Deviation Angle". The Gyro Multi-shot instrument consist of a magnetic compass and tilt indicator mounted above a spinning gyroscope. A camera with a timed shutter release is mounted so that multiple pictures can be taken of the magnetic compass reading and the tilt indicator. The operator at the surface then attaches the Gyro Multi-shot instrument to a "wire line" and lowers it into the borehole. The Gyro Multi-shot instrument is stopped at the desired depth where the timed shutter release is activated and a picture of the compass reading and tilt indicator is taken. The process is repeated until desired deviation angles are completed and the Gyro Multi-shot instrument is retrieved. The camera film is then retrieved, developed and analyzed. Although the Gyro Multi-shot instrument is accurate and reliable, development of the camera film and analysis of the deviation angles can take considerable additional time and is also vulnerable to the same problems of the "pendulum pin prick" mechanism method. In addition, the multi-shot method requires trained operators, thereby incurring additional cost.

3. SUMMARY OF THE INVENTION

Accordingly the instant invention addresses the shortcomings of the prior art by providing an improved method and system for autonomously gathering borehole measurement data. The improved system utilizes a low voltage, solid state electronic apparatus and a method for detecting and correlating desired measurements such as pitch, roll, azimuth and temperature taken from a bored hole in an autonomous manner, and recovering such data from the instrument upon its return to the surface. The apparatus itself utilizes electronic measurement sensing circuitry that includes a compass/magnetometer utilizing a tilt compensated linear compass, dual axis tilt system, an integrated circuit board having a low voltage programmable micro-controller unit that includes a micro-storage device, a micro-timing device, an onboard high temperature power supply unit including power regulating electronic circuit, and a capacitor circuit all housed in a high tensile strength non-metallic casing sleeve with a self centering capability. The system further includes electronic communications programming and retrieval cabling and a portable computer processor unit.

There is also disclosed a method for inputting data into and retrieving data from the borehole instrument. The method of operation includes the steps of providing the autonomous instrument with a an onboard computer program capable of establishing a start time delay, a timed interval for acquiring a plurality of desired duplicate measurements taken from the borehole, providing a time input method for inserting a time mark associated and identifiable with each of the data measurements taken autonomously down hole, and providing a method for storing a plurality of such measurements taken along the borehole path with their associated time marks in memory. The method includes a second computer program utilizing a computer-processing unit to process and display the desired measurements taken along the borehole retrieved from the autonomous instrument upon its recovery at the surface of the borehole. The computer processing system is capable of averaging the desired measurements taken at any given point along the borehole and displayed according to the actual depth at which the desired measurements occurred.

4. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

5. DETAILED DESCRIPTION OF THE PREFERRED EMBODIMENT

Figure 1:
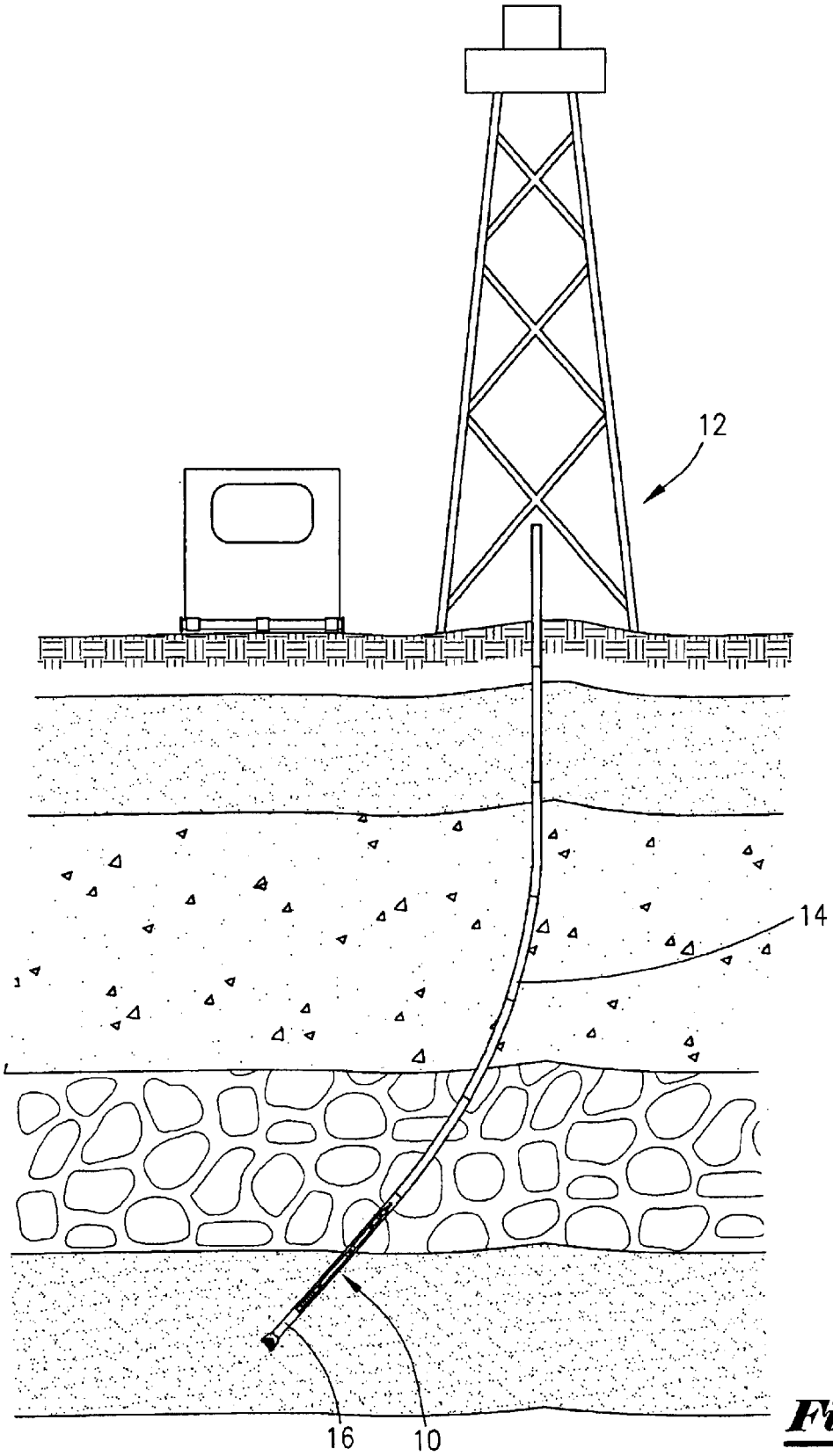
FIG. 1 is a cross section view of a well bore utilizing the deviation angle instrument package assembly.
Figure 2:
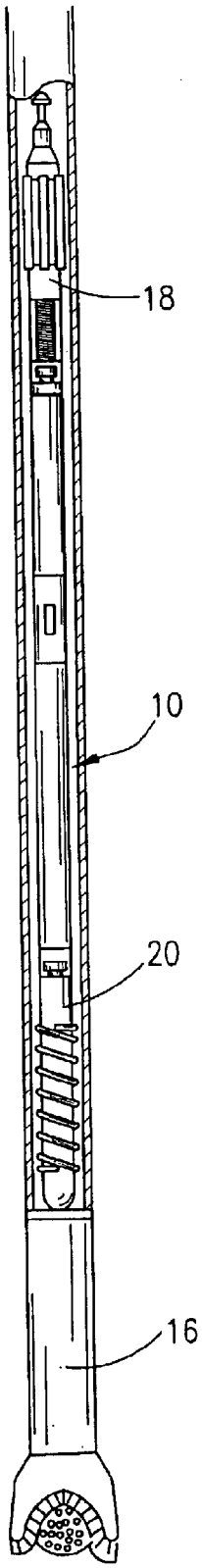
FIG. 2 is a cross sectional cut-a-way view of the deviation angle instrument package assembly and running gear located adjacent the drill bit.
Figure 4:
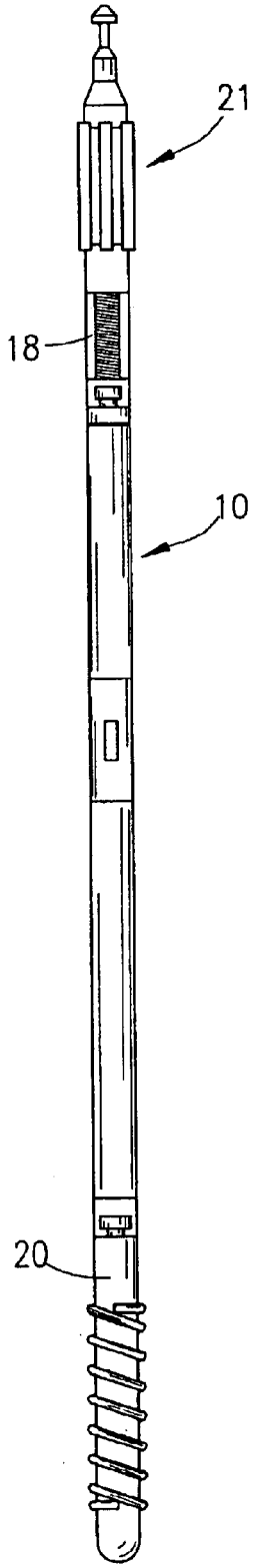
FIG. 4 is a side elevation view of the deviation angle instrument package and running gear with centralizer collapsed.
Figure 5:
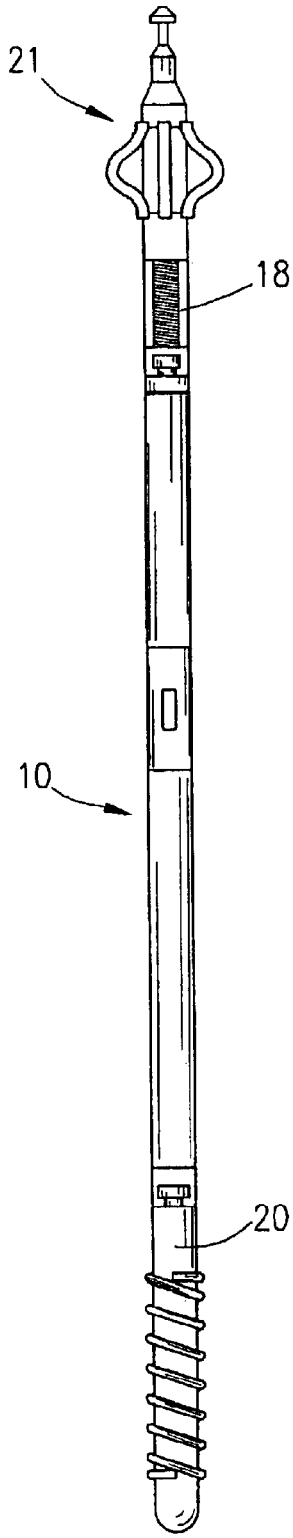
FIG. 5 is a side elevation view of the deviation angle instrument package and running gear with centralizer expanded.

As seen in FIG. 1, unlike most other well deviation angle instruments, the instant deviation angle instrument package assembly 10 may be operated completely autonomously with no communication with the surface of the well 12. The instrument package assembly 10 is simply preprogrammed and dropped into the bore of the drill string 14 and allowed sufficient time to reach the bottom of the well bore via the drill string internal bore to a point adjacent the drill bit 16. As shown in FIG. 2, the deviation angle instrument package assembly 10 is conveyed through the longitudinal bore of the drill string 14 by conventional running gear including upper connector member 18 and lower shock absorber connection member 20. The running gear component members 18,20 help cushion the instrument package assembly 10 and provide a means for retrieval if necessary. The running gear 18 and 20 also includes an expandable centralizer 21 shown in detail in FIGS. 5A and 5B and shown compressed in FIG. 4 and expanded upon impact with the bottom of the drill string in FIG. 5, thereby insuring that the instrument is maintained in a stable representative position of the true angular deviation of the drill string 14.

Figure 5A:
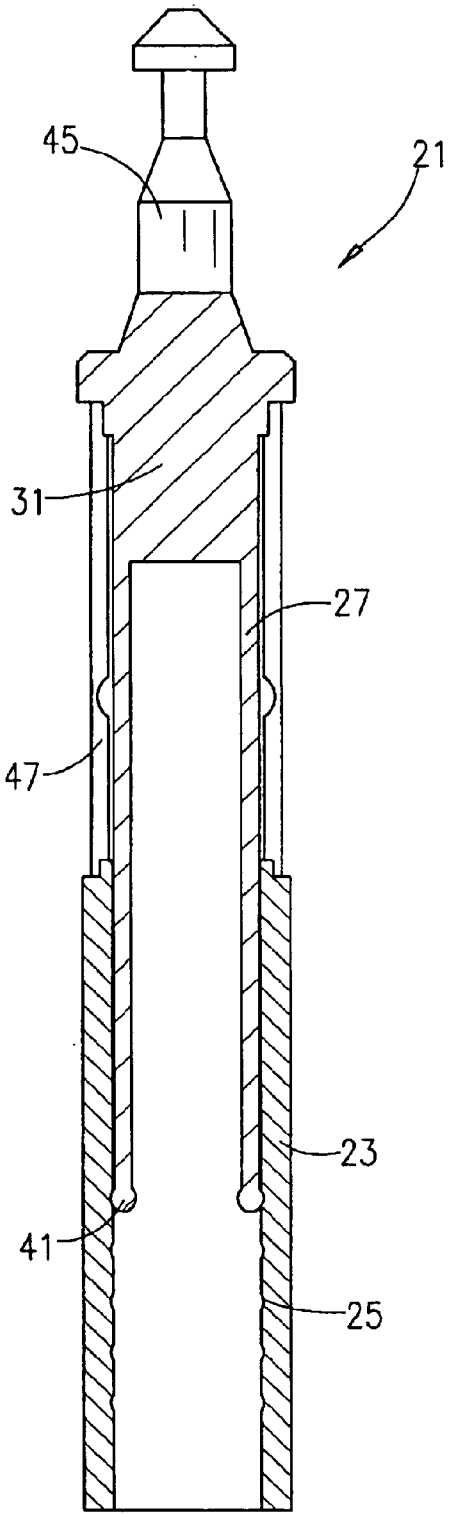
FIG. 5A is a partial cross section view of the centralizer retracted.
Figure 5B:
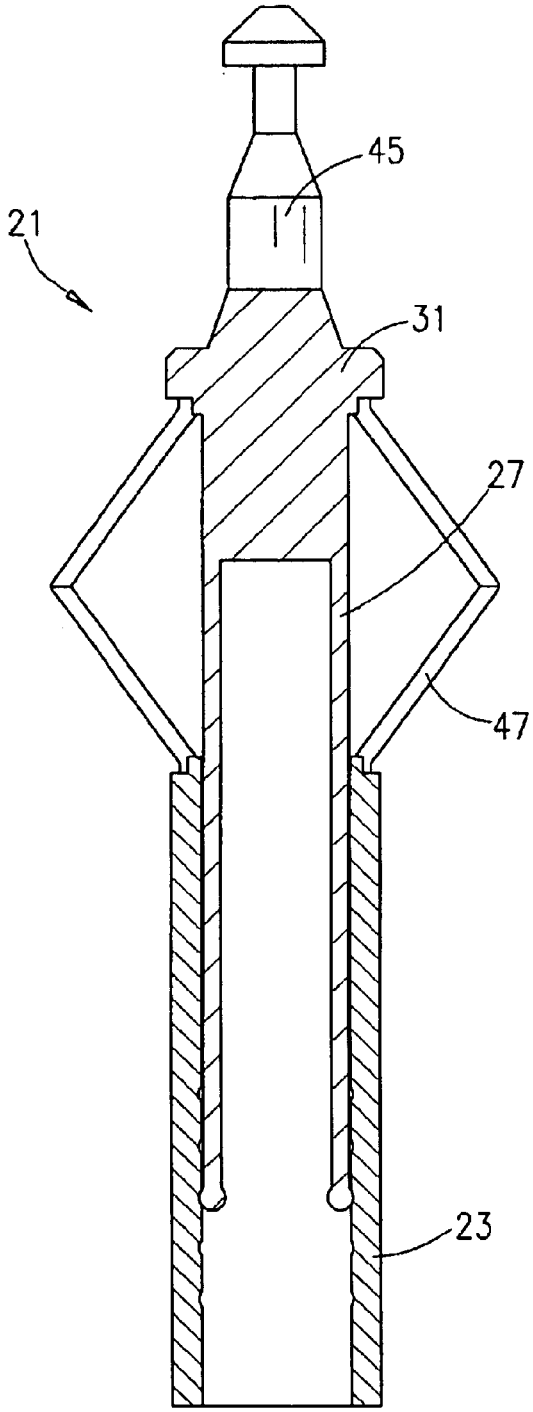
FIG. 5B is a partial cross section view of the centralizer extended.

A unique centralizer 21 used for impact deployment is detailed in FIGS. 5A and 5B and includes a tubular body member 23 with internal detent ridges 25, an elongated tubular member 27 with a solid portion 31 at one end and a detent means 41 located at the opposite end of the body 27 being telescopically slidable within the tubular body member 23, a swivel spear head 45 adapted for coupling with retrieval tools attached to the solid portion 31, and a flexible stabilizer band 47 located externally of and intermediate to said solid portion 31 of the tubular member 27 and the tubular body 25.

Figure 3:
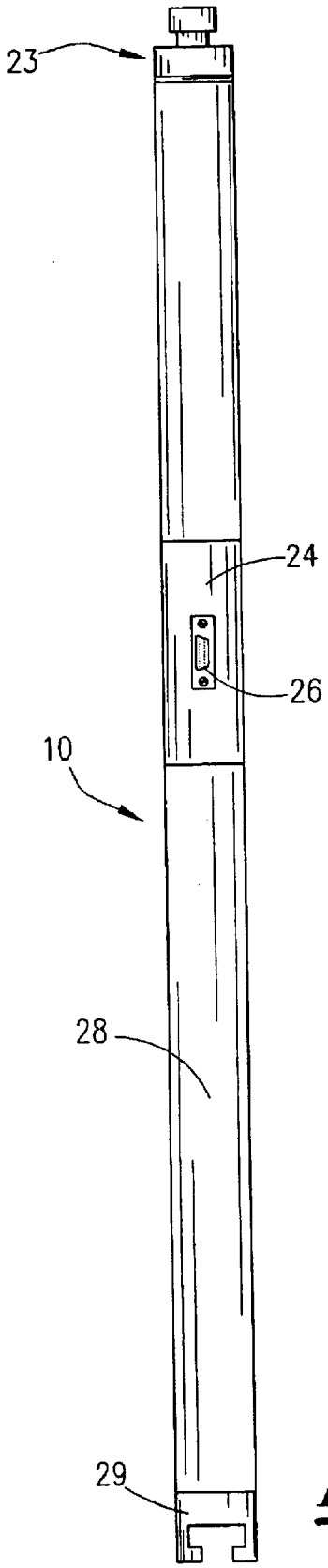
FIG. 3 is a side elevation view of the deviation angle instrument package.

The deviation angle instrument package assembly 10 seen in FIG. 3 is a non-metallic casing sleeve divided into three parts: the upper power supply housing 22 capable of connection to the upper running gear component 18 via male tandem sub and cap assembly 23, the communication sub housing 24 including its input/output port 26 and the lower housing 28 containing the electronic instrument components of the instrument, capable of connection to the lower shock absorber component 20 of the running gear via the female tandem sub 29.

Figure 6A:
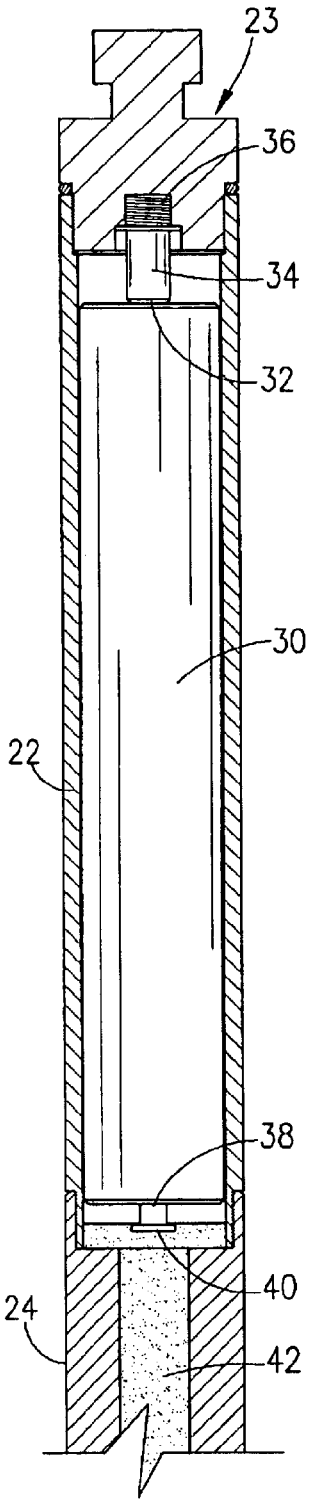
FIG. 6A is a partial cross section view of the deviation angle instrument package assembly.
Figure 6B:
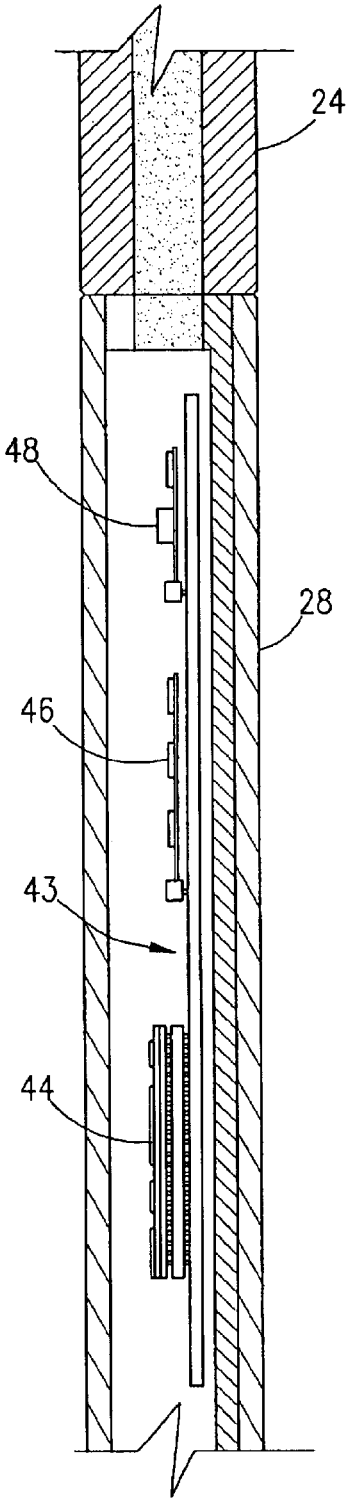
FIG. 6B is a partial cross section view of the deviation angle instrument package assembly.
Figure 6C:
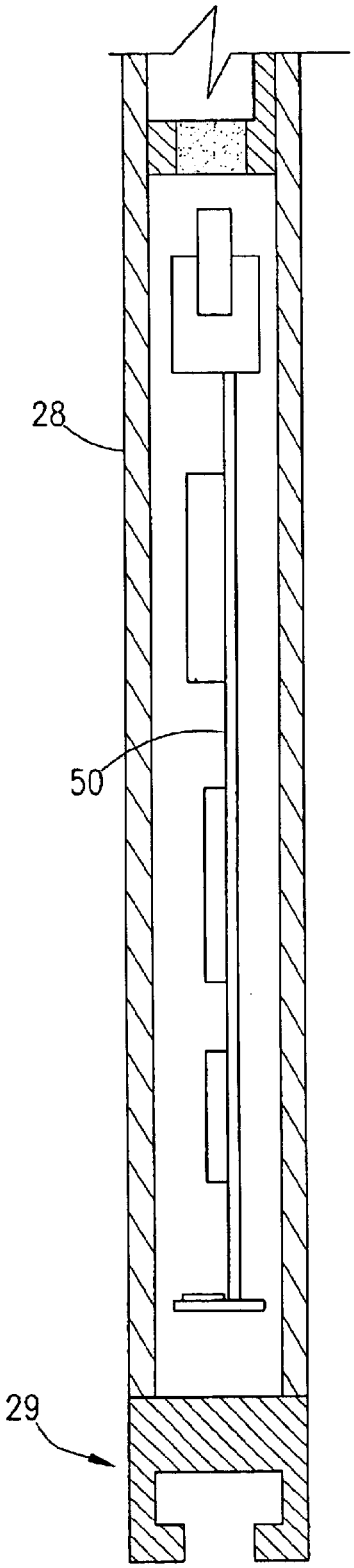
FIG. 6C is a partial cross section view of the deviation angle instrument package assembly.

Looking now at a cross section of the instrument package assembly 10 in FIG. 6A we see that the power supply housing 22 includes power supply in the form of a battery pack 30 arranged so that the battery pack's negative power terminal 32 is in contact with the negative terminal 34 biased by a spring 36 in contact with the metal cap 23. The positive end 38 of the battery pack is in contact with the positive system terminal node 40. The battery power pack may be between 7 and 25 volts and should be a capable of withstanding high heat and pressure such as a Lithium Bromide Cell. The voltage output to the compass and stamp computer is voltage compensated to 5 volts and a maximum of 52 milliamps. Wiring communication from the battery power supply 30 to the communications port 26, as seen in FIG. 3, is made via a central bore 42 located in the communication sub 24 and beyond to the lower housing 28 seen in FIG. 6B containing the electronic instrument components of the instrument. The instrument's electronic survey components 43, as seen in FIG. 6B, located in the lower housing seen in FIG. 6C, include a microprocessor 44, a micro data storage or memory card 46, a clock 48, and the angle/direction sensor 50. The angle/direction sensor unit 50 also includes a solid state, tilt compensated compass engine 51, a solid state, dual axis tilt or pitch engine 53, and a temperature monitor 55 as diagrammed in FIG. 7. The sensor unit 50 is capable of outputting a continuous heading, magnetic field, and dual axis tilt and temperature data over a wide range of interfaces. Azimuth is generated from its 3-axis semiconductor magnetometer. Linear tilt is provided with 12-bit resolution over +/−80 arc/deg. Resolution. The electronic survey components 43 are specifically designed in a vertical or linear circuit board configuration for this application.

Figure 8:
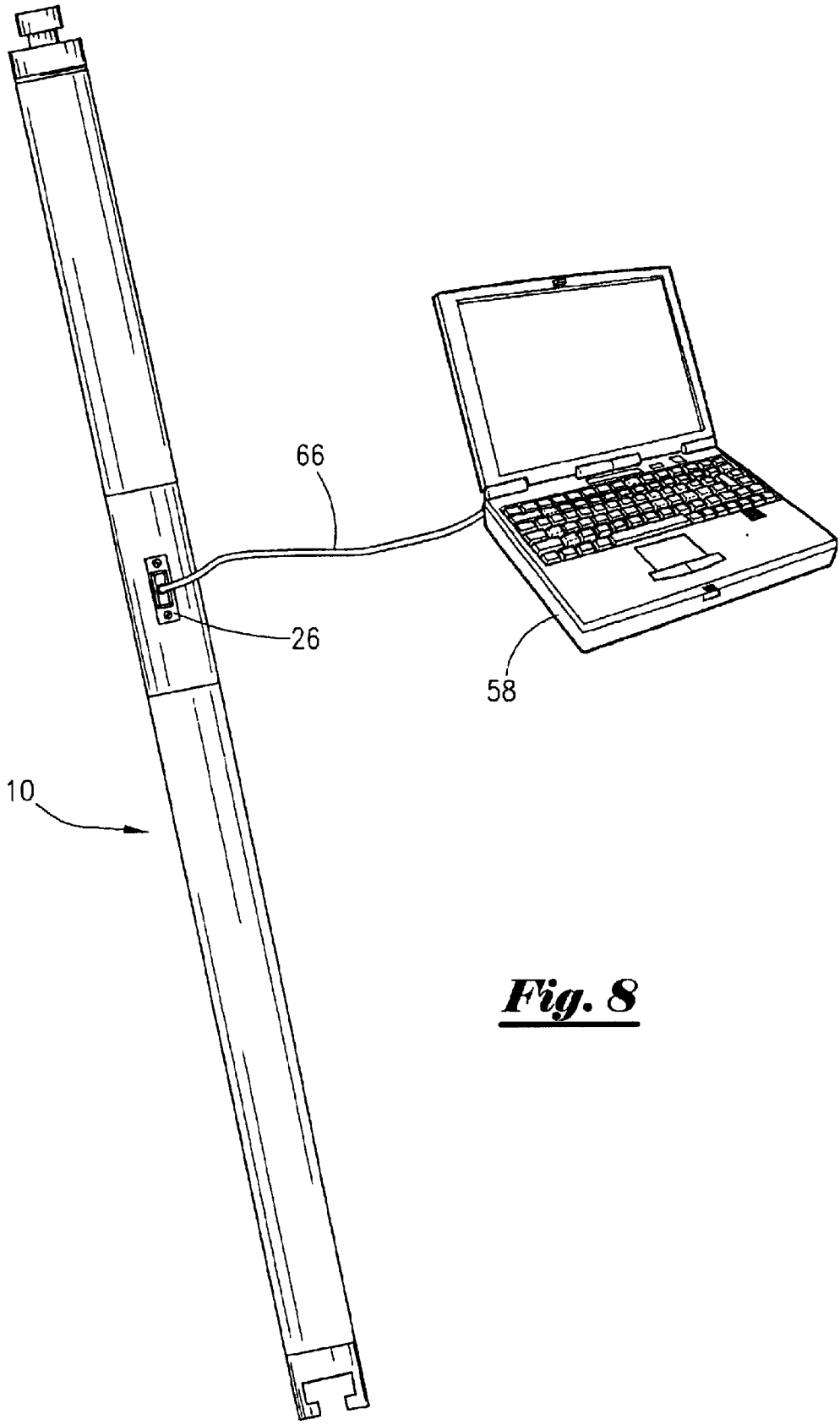
FIG. 8 is an isometric view of the input/output computer terminal and connection.
Figure 9:
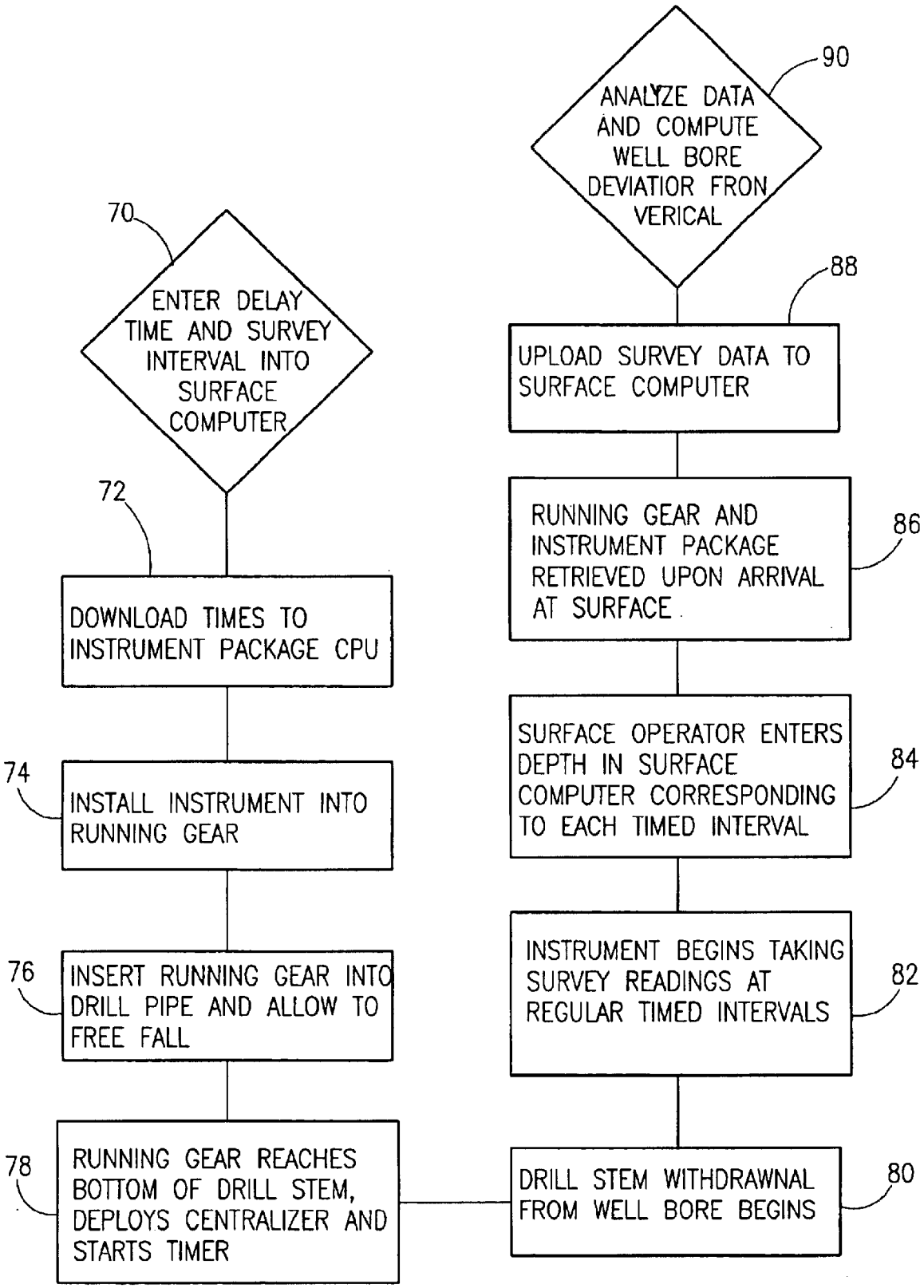
FIG. 9 is a process diagram.

In use, as diagrammed in FIG. 9, the first step 70 is to enter the desired well survey parameters, such as times and intervals, into the computer 58 seen in FIG. 8.

Since the instrument package assembly 10 is autonomous, it must be preprogrammed with the particular well parameters before being deposited within the drill string as seen in FIG. 8.

Figure 7:
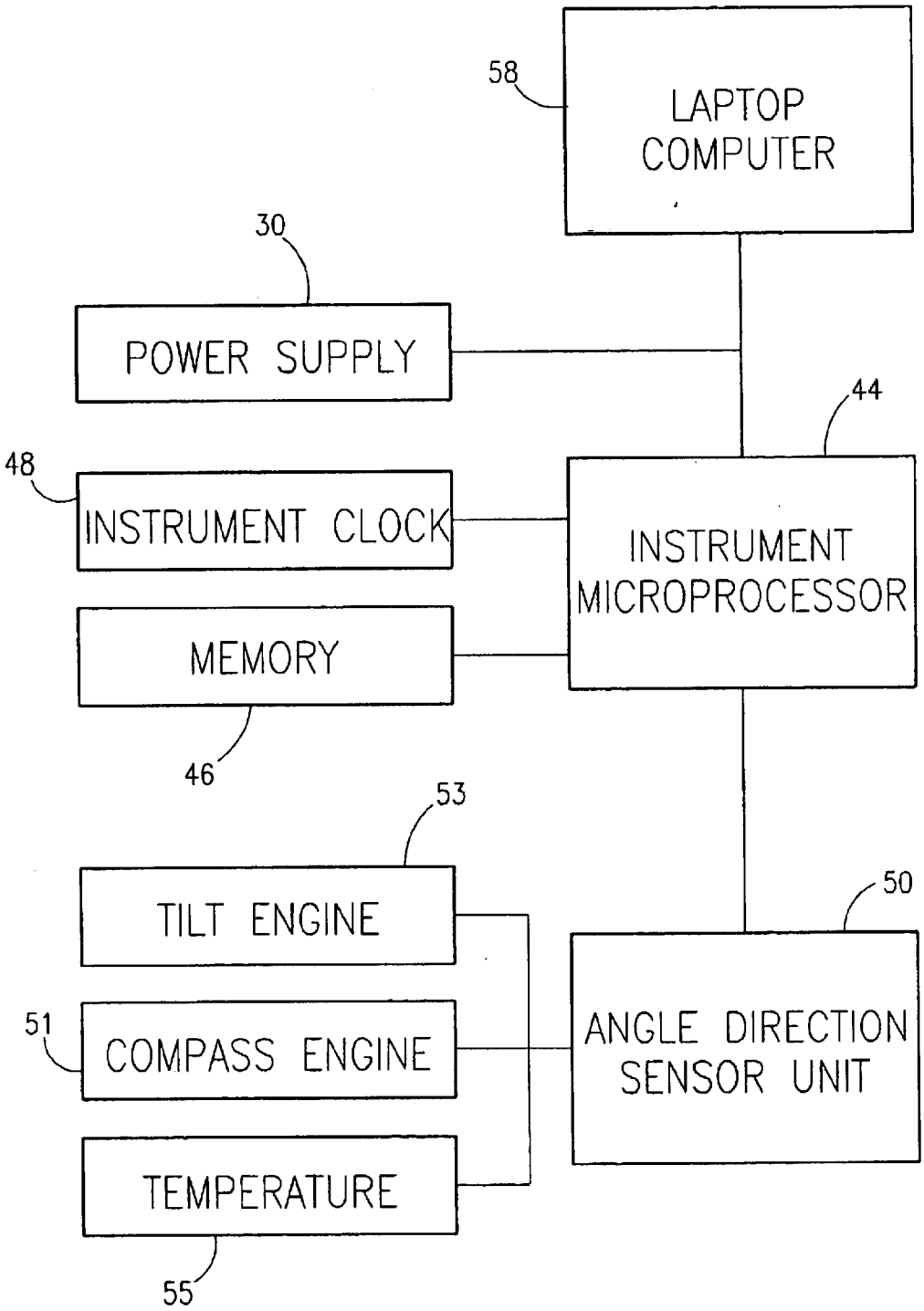
FIG. 7 is a block diagram of the components of the deviation angle instrument package.

The next step 72 is to program the instrument package assembly 10 by temporarily attaching the surface computer 58 to the communications port 26 with communications cable 66 as shown in FIG. 8, at which time the delay times and survey interval times are entered into the memory portion of the onboard microprocessor 44, seen in FIGS. 6B, 7, portion of the instrument survey package. Delay times are calculated based on the time computed for the instrument to freefall to the bottom of the well, generally about 1000 feet per minute, plus the anticipated time for insertion into the running gear 18,20 and deposition into the drill stem 14. Interval times are generally set for 3–5 minute intervals but depend generally on the operational time required to withdraw the drill stem sections. After installing the instrument package assembly 10 into the running gear 18,20 and inserting the running gear into the drill pipe or string, steps 74 and 76, the running gear 18, 20 is allowed to free fall to the bottom of the well. The impact of the running gear hitting bottom deploys 78 the centralizer assembly 21. After the "delay time" has expired 78, the micro controller 44 initiates a series of interrogations. The down hole micro controller 44 interrogates the clock 48 for a time stamp, the compass engine 51 for direction, angle, temperature, pitch and roll. Returns from these sensor readings are then sent to the micro data storage 46 for storage. This series of interrogations is completed four (4) times and stored in the micro data storage as the RAW file. The micro controller then "sleeps" until the next preprogrammed "survey interval" has expired.

During the next survey interval and while the micro controller "sleeps", the instrument package assembly 10 is being lifted to the next survey depth by removing or "tripping" the drill pipe 80, or while retrieving the instrument package assembly 10 and running gear assembly 18,20 by "wire-line". In either case, the interrogation process is repeated until the instrument reaches the surface and the instrument package assembly 10 is removed from the "self centralizing running gear" and the RAW data is downloaded to a Proprietary Visual Basic Laptop computer program 58.

The surface survey operator simultaneously enters the time of withdrawal of each section and the calculated depth of the instrument at that time 84. When the last remaining section of drill stem reaches the surface of the well, the instrument package assembly 10 is retrieved. The surface computer 58 is again connected to the instrument's communication port 26 and the stored survey data is uploaded to the surface computer 88.

The RAW survey data file is uploaded directly from data storage 46 via microprocessor 44 upon command from the surface computer 58. The RAW survey data file is provided in the following format:

RAW Data File

| Time | Direction | Angle | Temp | Pitch | Roll |
|---|---|---|---|---|---|
| T:00:00:01 | D:353.614 | A:25.071 | t:3.3 | P:22.06 | R:11.79 |
| T:00:00:06 | D:353.675 | A:25.079 | t:3.4 | P:22.19 | R:11.79 |
| T:00:00:11 | D:353.614 | A:25.106 | t:3.4 | P:22.25 | R:11.69 |
| T:00:00:16 | D:353.526 | A:25.068 | t:3.4 | P:22.10 | R:11.75 |

Notes:
T: time (time stamp for survey from clock on main board)
D: direction (magnetic direction reading from compass engine)
A: Angle (tilt angle computed by compass engine)
t: Temperature (internal temperature of the compass engine). (Not used in any computations)
P: Pitch (pitch angle from compass engine)
R: Roll (roll angle from compass engine)

A depth file is generated by the surface computer 58 based on a time stamp derived from its internal clock wherein the depth is entered manually by the surface operator and a finish time is derived from the difference between the time stamp and the actual manual input by the operator. The depth file is provided in the following format:

DEPTH FILE

| Time stamp | Depth | Finish |
|---|---|---|
| T:10:48:14, | 10,000, | 10:48:21 |
| T:10:51:07, | 9,000, | 10:51:09 |
| T:10:54:00, | 8,000, | 10:54:17 |
| T:10:56:52, | 7,000, | 10:56:56 |

Upon initiation of the survey process, the surface recording unit (laptop computer) 58 using the proprietary visual basic laptop program begins a series of depth interrogations. Using the same "survey interval" timing set in the micro controller 44, instrument package assembly 10, down hole, the surface recording unit (laptop) 58 will request a depth input from the operator at precisely the same time the micro controller 44 is interrogating the down hole clock 48 in the instrument package assembly 10. The operator then ascertains the survey depth by calculating the actual bit depth less the actual location of the instrument package assembly 10 within the drill string 14. The surface operator manually inputs into the laptop computer 58 the actual survey depth, which is then recorded and stored in the laptop memory in the "Depth File".

Should the operator decide for any reason that the survey taken at the interrogated depth is not valid, (i.e. pipe was moving, survey not valid); the operator can input "0" for "null" depth. If at any time, the depth input time and finish time exceeds 30 seconds, the proprietary visual basic laptop program 58 will initiate a "null" depth entry for that survey, and continue the timing sequence uninterrupted.

A "G" or gravitational file is generated as derived from the time stamp taken from the down hole clock 48 at each interval utilizing an average direction and tilt angle referenced with average temperature. The "G" file is a mathematical average of the four (4) survey samples to arrive at one averaged survey data sample. Note: As the tilt or deviation angle approaches zero, direction becomes vague or nonexistent. The compass engine therefore cannot distinguish direction below 1 degree and can cause degradation of all measurements. The compass engine manufactures installed a one-degree filter to eliminate possible discrepancies. It is important to the potential users of this instrument to read deviation angle below one degree. The "G" file therefore calculates an alternative tilt angle deviation from the formula:

$$\sqrt{\sqrt{P} + \sqrt{R}} = D,$$

The square root of the square root of the pitch plus the square root of the roll equals the deviation angle.

This file is generated in the following format:

G FILE

| Time | Pitch | Roll | Deviation |
|---|---|---|---|
| T:00:00:16, | 353.60725, | 22.2194177466467, | 3.375 |
| T:00:03:21, | 353.58975, | 22.2148289437484, | 3.4 |
| T:00:06:25, | 353.59325, | 22.2575915419885, | 3.4 |
| T:00:09:30, | 353.581, | 22.2473661362418, | 3.4 |

A "C" or compiled file is generated by integrating the "G" file data and the "D" depth files to arrive at one sample survey for each time stamp and a depth for each sample. (null samples are disregarded). The file consist of:

C: Compiled File

| Time | Avg. pitch | Avg. roll | DEV. Angle | Time stamp | Depth | Finish time |
|---|---|---|---|---|---|---|
| T:00:00:16, | 353.60725, | 22.219, | 3.375 | !!!10:48:14, | 10000, | 10:48:21 |
| T:00:03:21, | 353.58975, | 22.214, | 3.4 | !!!10:51:07, | 9000, | 10:51:09 |
| T:00:06:25, | 353.59325, | 22.257, | 3.4 | !!!10:54:00, | 8000, | 10:54:17 |

-continued

C: Compiled File

| Time | Avg. pitch | Avg. roll | DEV. Angle | Time stamp | Depth | Finish time |
|---|---|---|---|---|---|---|
| T:00:09:30, | 353.581, | 22.247 | 3.4 | !!!10:56:52, | 7000, | 10:56:56 |

Notes:
T: time stamp from down hole clock, direction (averaged), tilt angle (averaged), internal temperature (averaged), !!! Time stamp (from laptop), Depth (manual input from laptop), Finish time (from laptop)

A "P" or process file is produced that combines the pertinent well information with the data from the compiled file in rich text format for import into a spreadsheet format. This file is produced in the following format and consists of:

P-FILE

| Measured Depth | Drift Angle | Drift Direction |
|---|---|---|
| 10,000, | 22.219, | N,6.38,W |
| 9,000, | 22.215, | N,6.41,W |
| 8,000, | 22.258, | N,6.41,W |
| 7,000, | 22.247, | N,6.42,W |

Notes:
Measured Depth, Drift angle (tilt angle), Direction, (converted to quadrant from degrees)

Spreadsheet

A spreadsheet is produced consisting of two pages; page two is a gathering point indicating that the processed file is received. Page one of the spreadsheet is the finished product and printable hard copy of the imported data and the calculations derived from the survey data.

Using industry standard calculations, and other manual inputs, the spreadsheet can calculate sub sea depth, true vertical depth, vertical section, North/South variance, East/West variance, dogleg severity, and closure distance and direction.

With this instrument, very precise and reasonably accurate well bore deviation angles can be recorded while tripping resulting in considerable savings due to significant down time required when using a wire-line.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. An autonomous down hole instrument package assembly for determining deviation angles off vertical comprising:

a) a non-conductive cylindrical body member having metallic end caps for connection to typical down hole running gear, said body having an electronic communication port externally accessible;

b) a means for disassembling said body member into a plurality of sub-sections;

c) a self-contained power supply located within one of said sub-sections;

d) a microprocessor connected electrically to said power supply and said communication port located within one of said sub-sections;

e) a solid-state angle direction-sensing unit having at least a tilt engine and a compass engine capable of determining deviation angles off vertical connected to said microprocessor located within at least one of said subsection.

2. The autonomous down hole instrument package assembly according to claim 1 wherein said running gear comprises a lower shock absorbing member and an upper member containing a self deploying centralizing means.

3. The autonomous down hole instrument package assembly according to claim 2 wherein said self deploying centralizing means comprises a first elongated tubular body member having internal detent ridges, a second elongated tubular member having a solid portion at one end and a detent means located at the opposite end, said second tubular member being telescopically slidable within said first elongated tubular body member, a swivel spear head member adapted for coupling with retrieval tools, attached to said solid portion and a flexible stabilizer band located externally of and intermediate to said solid portion of said second tubular member and said first tubular body member.

4. The autonomous down hole instrument package assembly according to claim 1 further comprising a surface computer loaded with a proprietary program and at least one communication cable connectable between said surface computer and said communication port.

5. The autonomous down hole instrument package assembly according to claim 1 wherein said power supply comprises a high temperature and pressure resistant dry cell battery pack having a voltage between 7 and 25 volts with voltage and current regulation to 5 volts and a maximum of 52 milliamps.

6. The autonomous down hole instrument package assembly according to claim 1 wherein said sensing unit further comprises a temperature monitor.

7. The autonomous down hole instrument package assembly according to claim 1 wherein said microprocessor further comprises an instrument clock.

8. An autonomous down hole instrument package assembly for determining deviation angles off vertical comprising:

a) a non-metallic sealed casing sleeve comprising:

i) a power supply sub-section containing a battery pack;

ii) a communication sub-section including an input/output communication port attached to said power supply subsection;

iii) an instrument sub-section containing an electronic instrument package assembly connected electrically to said battery pack and said connector port;

b) a means for removably connecting said casing sleeve to a down hole running gear assembly;

c) a computer means for preloading well survey parameters into said instrument package assembly and extracting accumulated data; and d) an electrical communication means for temporarily connecting said computer means to said input/output communication port.

9. The multi-shot autonomous down hole instrument package assembly according to claim 8 wherein said running gear comprises a deployable centralizer.

10. The multi-shot autonomous down hole instrument package assembly according to claim 8 wherein said battery pack is a high temperature and pressure resistant dry cell having a voltage between 7 and 25 volts with voltage and current regulation to 5 volts and a maximum of 52 milliamps.

11. The multi-shot autonomous down hole instrument package assembly according to claim 8 wherein said instrument package assembly comprises a microprocessor, a micro data storage card, a clock, an angle/direction sensor having a solid state tilt compensated compass engine with dual axis tilt sensor, a solid state tilt or pitch engine, and a temperature monitor all arranged on a linear circuit board.

12. The multi-shot autonomous down hole instrument package assembly according to claim 8 wherein said computer utilizes a proprietary computer program for analyzing accumulated down hole data.

13. The multi-shot autonomous down hole instrument package assembly according to claim 9 wherein said centralizer comprises:

a) a tubular body member having internal detent ridges;

b) a elongated tubular member having a solid portion at one end and detent means at the opposite end, said body being telescopically slidable within said tubular body member;

c) a swivel spear head adapted for coupling with retrieval tools attached to said solid portion; and d) a flexible stabilizer band located externally of and intermediate to said solid portion of said tubular member and said tubular body.

14. The multi-shot autonomous down hole instrument package assembly according to claim 13 wherein said stabilizer band expands outwardly upon longitudinal impact of the running gear with the bottom of the well.

15. A method for determining deviation angles off the vertical axis of a well bore comprising the steps of a) preprogramming an autonomous solid state down hole instrument package assembly having an onboard microprocessor and memory storage capability with instructions for taking a plurality of instrument sensor readings starting at a predetermined time and at precise time intervals thereafter;

b) recording said sensor readings in said memory storage;

c) fitting said instrument package assembly with down hole running gear having shock absorbing and self-deployable centralizer capability;

d) inserting said instrument package assembly and running gear within the central bore of a drill stem extending to the bottom of a well bore to be surveyed;

e) allowing said instrument package assembly and running gear to free fall through said central bore to impact at the bottom of said drill stem;

f) withdrawing said drill stem containing said instrument package assembly and running gear;

g) recording depth of said instrument package assembly on a surface computer at timed intervals corresponding to timed sensor readings being taken by the instrument package assembly;

h) recovering said instrument package assembly upon its return to the surface and downloading data stored in said memory storage to said surface computer; and i) Processing the recovered data with a proprietary program and thus producing a deviation profile of the well bore relative to the vertical axis.

16. A method for determining deviation angles off the vertical axis of a well bore comprising the steps of:

a) Utilizing a multi-shot autonomous down hole instrument package assembly comprising:

i) a non-conductive cylindrical body member having metallic end caps for connection to typical down hole running gear, said body having an electronic communication port externally accessible;

ii) a means for disassembling said body member into a plurality of sub-sections;

iii) a self-contained power supply located within one of said sub-sections;

iv) a microprocessor connected electrically to said power supply and said communication port located within one of said sub-sections;

v) a solid-state angle direction-sensing unit having at least a tilt engine and a compass engine capable of determining deviation angles off vertical connected to said microprocessor and a clock located within at least one of said subsections;

b) programming said instrument package assembly for autonomous operation down hole by down load from a surface computer means;

c) connecting said instrument package assembly to said running gear;

d) depositing said instrument package assembly and said running gear into the central bore of a drill string and allowing said running gear to free fall to the bottom of said drill string;

e) responding to a dialogue request prompted by said surface computer means;

f) recovering said instrument package assembly upon its return to the surface of said well bore;

g) interrogating said instrument package assembly electronically to recover stored sensor data taken at timed intervals down hole, uploading said data to said computer means; and h) analyzing said data and preparing charts electronically via a proprietary computer program for download and printout.

17. The method for determining deviation angles off the vertical axis of a well bore according to claim 16 wherein said step of programming said instrument package assembly for autonomous operation down hole by down load from a surface computer means further comprises the steps of connecting said instrument package assembly to said surface computer via a communication cable connecting said communication port, and said surface computer.

18. The method for determining the deviation angles off the vertical axis of a well bore according to claim 16 wherein said step of programming said instrument package assembly comprises entering delay time and survey interval time into the memory portion of said microprocessor.

19. The method for determining the deviation angles off the vertical axis of a well bore according to claim 18 wherein said delay time is calculated based on the time computed for the instrument to freefall to the bottom of the well, generally about 1000 feet per minute, plus the anticipated time for insertion into the running gear and the deposition into the drill stem with interval times generally set for 3–5 minute intervals.

20. The method for determining the deviation angles off the vertical axis of a well bore according to claim 18 wherein said interval time is based on the operational time required to withdraw drill stem sections from said well bore.

21. The method for determining the deviation angles off the vertical axis of a well bore according to claim 16 wherein said running gear comprises a self-deploying centralizing assembly, said assembly being deployed on impact of the instrument package assembly with the bottom of the well bore.

22. The method for determining the deviation angles off the vertical axis of a well bore according to claim 16 wherein said steps further include the step of initiating a series of interrogations of said sensing unit for data in the form of a temperature sensor, a time stamp from said clock, direction and angle, from said compass engine, pitch and roll returns from said tilt engine, storing said data return from each said interrogation within a data memory bank as a RAW file.

23. The method for determining the deviation angles off the vertical axis of a well bore according to claim 16 wherein said steps further include the step of interrogating said sensing unit four times for each said survey interval time.

24. The method for determining the deviation angles off the vertical axis of a well bore according to claim 16 wherein said steps further include the step of allowing said microprocessor to sleep between preprogrammed survey intervals.

25. The method for determining the deviation angles off the vertical axis of a well bore according to claim 16 wherein said steps further include the step of ascending the instrument package assembly from the well bore as a result of removing the drill pipe from the well bore at least one joint at a time while initiating surveys at said preprogrammed timed intervals.

26. The method for determining the deviation angles off the vertical axis of a well bore according to claim 16 wherein said steps further include the step of ascending the instrument package assembly from the well bore by wire-line.

27. The method for determining the deviation angles off the vertical axis of a well bore according to claim 16 wherein said steps further include the step of making a time and depth entry in said surface computer simultaneously with said preprogrammed time interval entered in said microprocessor down hole.

28. The method for determining the deviation angles off the vertical axis of a well bore according to claim 27 wherein said depth entry is made according to the length of drill pipe being removed from the well bore at each interval.

29. The method for determining the deviation angles off the vertical axis of a well bore according to claim 16 further comprising the step of removing said instrument package assembly from said running gear and downloading data stored in said memory into said surface computer.

30. The method for determining the deviation angles off the vertical axis of a well bore according to claim 29 further comprising the step of analyzing said data using a proprietary computer program, creating a plurality of files for output containing a profile of the deviation angle of the well bore relative to a vertical axis.

31. The method for determining the deviation angles off the vertical axis of a well bore according to claim 30 wherein said deviation angles are derived by averaging the data taken at each interval and applying the formula $$\sqrt{\sqrt{P} + \sqrt{R}} = D.$$

* * * * *